United States Patent [19]

Seragnoli et al.

[11] Patent Number: 4,472,990

[45] Date of Patent: Sep. 25, 1984

[54] CUTTING DEVICE FOR CONTINUOUS RODS OF SMOKING PRODUCTS

[75] Inventors: Enzo Seragnoli; Riccardo Mattei, both of Bologna, Italy

[73] Assignee: G.D Societa' per Azioni, Bologna, Italy

[21] Appl. No.: 472,576

[22] Filed: Mar. 7, 1983

[30] Foreign Application Priority Data

Mar. 29, 1982 [IT] Italy ..... 48119 A/82

[51] Int. Cl.[3] ..... B26D 7/12

[52] U.S. Cl. ..... 83/174.1; 51/247; 83/340; 83/699

[58] Field of Search ..... 83/174.1, 174, 340; 51/247; 76/85

[56] References Cited

U.S. PATENT DOCUMENTS

| | | | |
|---|---|---|---|
| 1,933,785 | 11/1933 | Brandt | 83/174 X |
| 2,297,468 | 9/1942 | Graupner | 83/174 X |
| 3,258,881 | 7/1966 | Mason et al. | 83/174 X |
| 3,753,379 | 8/1973 | Molins et al. | 83/174 |
| 4,065,880 | 1/1978 | Maw | 51/247 |

*Primary Examiner*—Frank T. Yost

*Attorney, Agent, or Firm*—Marshall, O'Toole, Gerstein, Murray & Bicknell

[57] ABSTRACT

A device for cutting continuous rods of smoking products, in which a rotary cutting head is provided with a radial blade inclined with respect to the axis of rotation of the head, the blade being sharpened, upon each rotation of the head, by a frusto-conical grinding wheel carried eccentrically by a sharpening head rotatable about an axis substantially perpendicular to that of the blade carrier head, the radial position of the grinding wheel on the associated wheel-carrier head being adjustable together with the position of a counter weight, and the grinding wheel being carried into rotation about its axis by means of an air motor.

8 Claims, 3 Drawing Figures

Fig.3
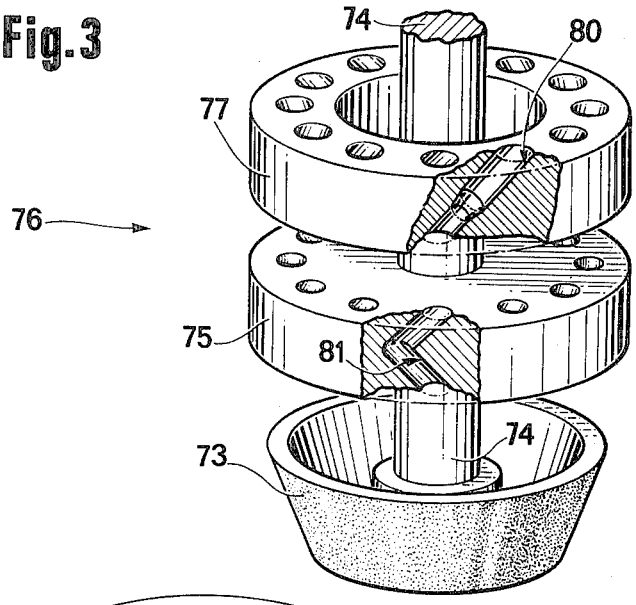
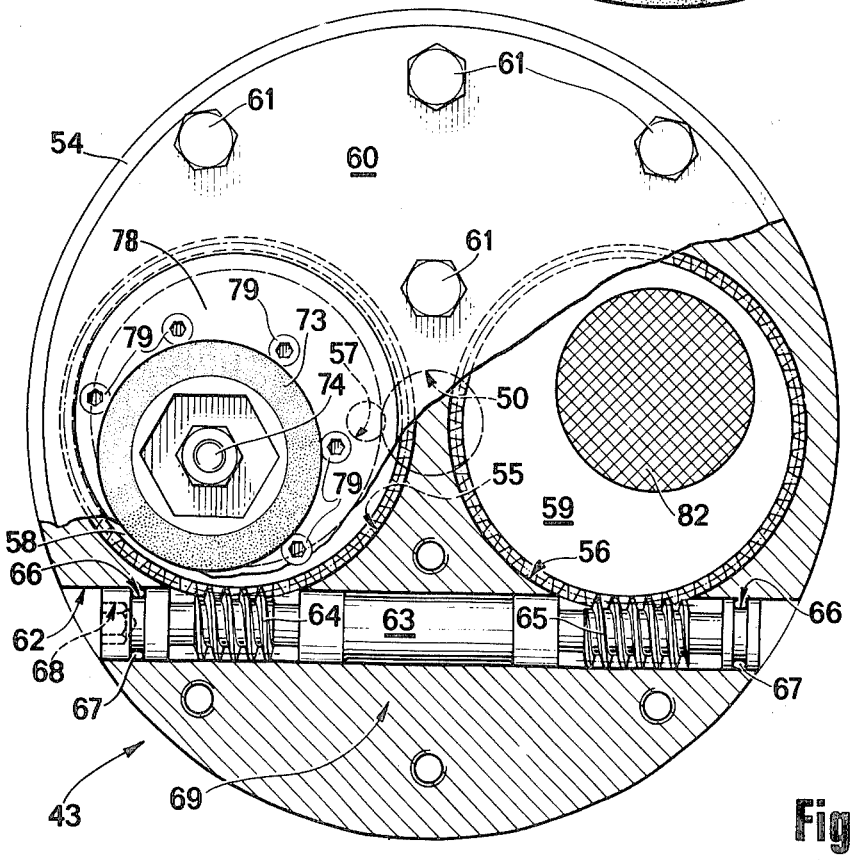
Fig.2

CUTTING DEVICE FOR CONTINUOUS RODS OF SMOKING PRODUCTS

BACKGROUND OF THE INVENTION

The present invention relates to a cutting device for continuous rods of smoking products.

In particular, the present invention relates to a cutting device for continuous rods of cigarette, of the type comprising a blade carrier head rotatable about an axis substantially parallel to a direction of advancement of the said rod and provided with at least one so-called 'helical' blade extending radially outwardly of the blade carrier head itself. Upon each rotation of this latter, each blade is sharpened by at least one grinding wheel of frustoconical form carried by a wheel-carrier head rotatable in phase with the blade carrier head about an axis substantially perpendicular to the axis of rotation of the blade carrier head itself. In known cutting devices of the above described type the said grinding wheel or stone is mounted eccentrically on the associated head for the purpose of being able to perform, following each rotation of the grinding wheel carrier head about its own axis, a displacement having a component parallel to the axis of the blade carrier head. The grinding wheel is in this way capable of following a path such as to come successively into contact with every point on the cutting edge of the blade to be sharpened.

In such cutting devices the blade carrier head is normally adjustable for the purpose of being able to adapt the cut to cigarettes of different size. This adjustment normally comprises a variation of the inclination of each blade with respect to the axis of the blade carrier head, with a consequent variation in the path of the points of the cutting edge of each blade. Consequently, the law of displacement of the grinding wheel must be modified by varying the eccentricity with respect to the axis of the grinding wheel carrier head.

For the purpose of being able to achieve what has been described above, in known cutting devices, it has been necessary to face and resolve several constructional problems such as those concerning the formation of a device for adjusting the eccentricity of each grinding wheel so as to maintain the grinding wheel carrier head perfectly balanced and to permit the transmission to the grinding wheel of a rotary movement about its axis whatever the position of the grinding wheel on the grinding wheel carrier head.

In known cutting devices the problems described above are resolved by providing the grinding wheel carrier head with a certain number of interchangeable pieces selectively mountable on the grinding wheel carrier head itself upon variation in the size of the cigarette to be obtained. Obviously, such a solution significantly affects the cost of the grinding wheel carrier head and notably increases the working dead times.

SUMMARY OF THE INVENTION

The object of the present invention is that of providing a cutting device which will be free from the above described disadvantages.

The said object is achieved by the present invention in that it relates to cutting devices for continuous rods of smoking products, in particular cigarettes, comprising a blade carrier head rotatable about a first axis which is adjustable in inclination and provided with at least one outer radial blade inclined with respect to the said first axis, a grinding wheel carrier head mounted on a support to rotate with respect to this latter about a second axis substantially perpendicular to the said first axis and facing the outer periphery of the said blade carrier head, a drive train interposed between the said blade carrier head and the said grinding wheel carrier head for rotating this latter about the said second axis in a determined phase relation with the angular position of the said blade carrier head about the said first axis, a grinding wheel mounted eccentrically on the said grinding wheel carrier head and able to cooperate with a cutting edge of each said blade, means for adjusting the eccentricity of the said grinding wheel, and drive means for driving the said grinding wheel to rotate about a third axis parallel to the said second axis, characterised by the fact that the said grinding wheel carrier head includes an eccentric balancing weight, the said adjustment means being operable to displace both the said grinding wheel and the said balancing weight simultaneously and in opposite senses in a direction transverse the said second axis, and the said drive means including a pneumatic motor.

BRIEF DESCRIPTION OF THE DRAWINGS

Further characteristics and advantages of the present invention will become apparent from the following description with reference to the attached drawings, which illustrate a non limitative embodiment thereof, in which:

FIG. 2 is a side view with parts in section and parts removed for clarity of a detail of FIG. 1; and FIG. 3 is a partial schematic perspective view of a second detail of FIG. 1.

DETAILED DESCRIPTION OF THE INVENTION

Figure 1:
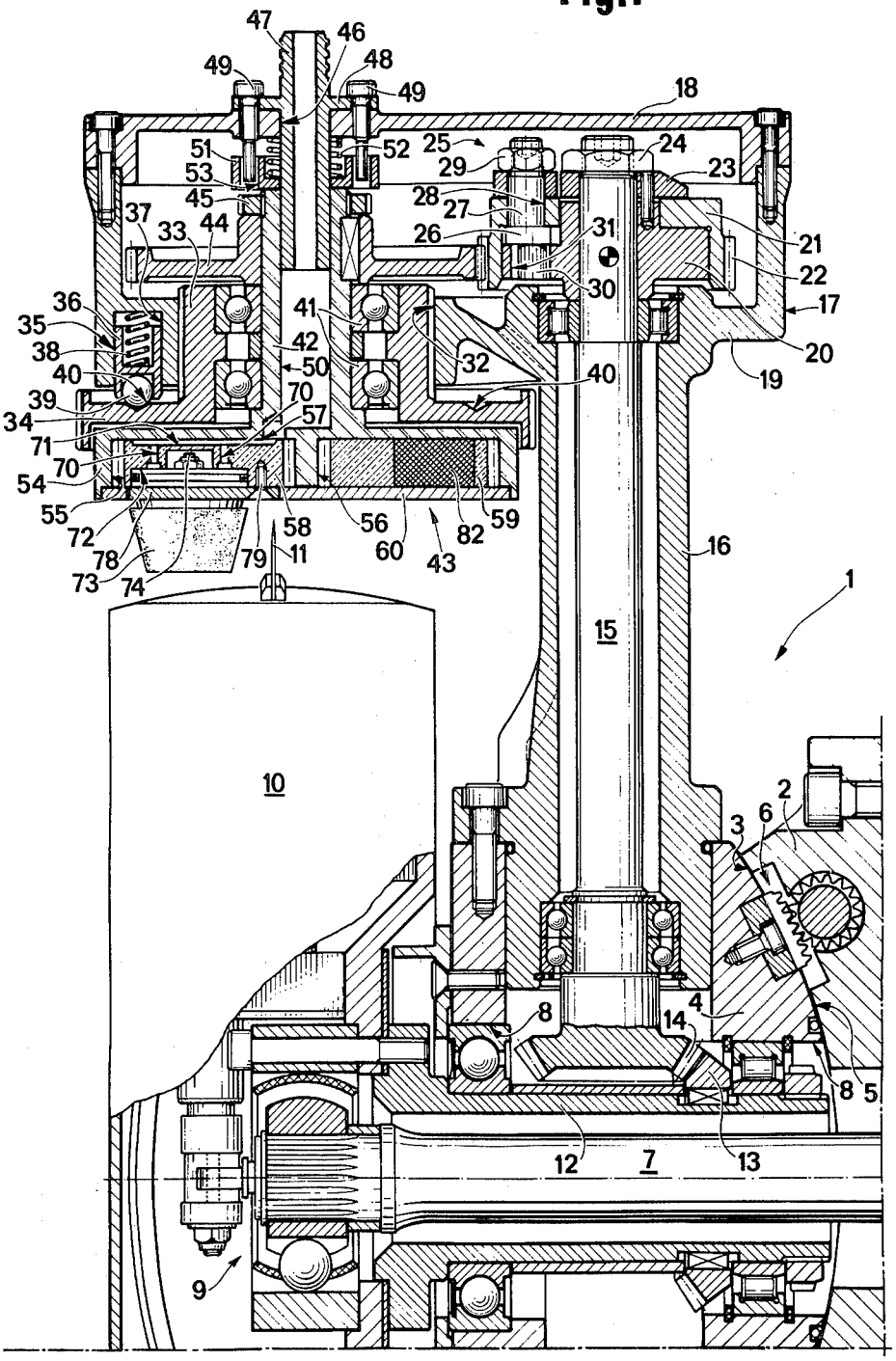
FIG. 1 is an axial section of a cutting device formed according to the principles of the present invention.

In FIG. 1 there is shown a cutting device 1 for cutting a rod of cigarette (not illustrated) movable in a substantially horizontal direction, into pieces of a determined length. The device 1 is connected to a support 2 on a front surface of which is formed a cylindrical recess 3 with a substantially vertical axis perpendicular to the direction of advancement of the said rod.

The device 1 includes a casing 4 a lateral convex surface 5 of which is of cylindrical form, is slidably coupled in the recess 3, and is angularly adjustable with respect to this latter by means of a rack and pinion coupling 6.

From the support 2 projects a drive shaft 7 which extends along a hole 8 in the casing 4 and projects from this latter to connect, by means of a constant velocity joint 9, with a blade carrier head 10 of substantially cylindrical form provided, around its outer periphery, with at least one blade 11 of the so-called "helical" type. To the head 10 there is rigidly connected a bush 12 coaxial with the hole 8 and rotatable within it. On the outer surface of the bush 12 there is keyed a bevel gear 13 the axis of which is substantially parallel to the direction of advancement of the said rod (not illustrated), coupled to a bevel gear 14 connected to the end of a substantially horizontal shaft 15 perpendicular to the shaft 7. The shaft 15 extends within a tubular projection 16 of a substantially cup shape casing 17 connected to the casing 4 and which is closed by a removable cover 18 connected to the casing 17 in a position opposite bottom wall 19 to which the projection 16 is rigidly connected.

On one end of the shaft 15 extending into the casing 17 there is keyed a cylindrical body 20 on which is rotatably keyed a cup-shaped body 20 which is concave towards the wall 19 and has an outer cylindrical toothing 22. The cup-shape body 21 is axially fixed with respect to the cylindrical body 20 by means of a plate 23 which has a hole engaged by the shaft 15 and is pressed into contact with an axial end of the cup-shape body 21 by means of a nut 24.

The angular position of the cup-shape body 21 with respect to the cylindrical body 20 is adjustable by means of a micrometer adjustment device 25 comprising a cylindrical disc 26 interposed between an axial surface of the body 20 and a corresponding inner surface of the body 21. From one end of the disc 26 extends a pin 27 which is coaxial with the disc 26 and rotatably engaged within a hole 28 formed through a bottom wall of the cup 21. The pin 27 has a threaded end section projecting out of the hole 28 engaged by a nut 29 capable of angularly and axially fixing the pin 27 with respect to the cup-shape body 21 in a releasable manner. From the side opposite that carrying the pin 27 the disc 26 carries, connected thereto, an eccentric pin or axial projection 30 which is coupled in a transversely slidable manner in a radial slot 31 formed through the cylindrical body 20.

Through the wall 19 is formed a threaded hole 32 the axis of which is parallel to that of the tublar projection 16, which is engaged by an externally threaded tubular body 33 provided with an externally knurled end flange 34 located outside the casing 17 and facing the outer periphery of the blade carrier head 10. By acting on the flange 34 it is possible selectively to displace the tubular body 33 into a plurality of defined angular positions with respect to the casing 17. The tubular body 33 is fixable in each of the said angular positions by means of a locking device 35 including a cup body 36 slidable within an axial recess 37 formed in the wall 19. The cup body 36 is thrust towards the flange 34 by a spring or resilient means 38 and supports a ball 39 which can selectively engage a plurality of notches or seats 40 uniformly distributed around the surface of the flange 34 facing the wall 19. Within the tubular body 33 is rotatably supported, by means of bearings 41, a tubular shaft 42 one end of which faces the head 10 and is rigidly connected to a grinding wheel carrier head 43, whilst the upper end projects into the casing 17 and carries keyed thereto a toothed wheel 44 fixed axially on the tubular shaft 42 and against the bearings 41 by means of a ring nut 45. The toothed wheel 44 has straight cut teeth and meshes with straight cut teeth 22, which latter teeth have a greater length than that of the teeth of the toothed wheel 44 for reasons which will become clearer below.

Through the cover 18 is formed a through hole 46 having an axis parallel to the shaft 15 and coaxial with the shaft 42. The hole 46 is engaged by a tubular coupling 47 from a central portion of which extends radially outwardly a flange 48 connected in contact with the outer surface of the cover 18 by means of screws 49. A portion of tubular coupling 47 extends out from the cover 18 and can be connected, by means of a duct (not illustrated), to a source of air under pressure (not illustrated). The remaining part of the tubular coupling 47 extends into the casing 17 and engages in a slidable, rotatable and fluid tight manner the cylindrical surface of an internal axial hole 50 of the shaft 42. The said seal of the coupling between the tubular connector 47 and the tubular shaft 42 is further guaranteed by an annular body 51 maintained in contact with the free end of the tubular shaft 42 by means of a spring 52 and held angularly fixed with respect to the cover 18 by means of the screws 49. The ends of which are in the form of cylindrical pins engaged slidably within axial through holes 53 formed through the annular body 51.

The wheel-carrier head 43 includes a cylindrical body 54 rigidly connected to the tubular shaft 42 and coaxial therewith. The cylindrical body 54 has two cylindrical hollows or chambers 55 and 56 disposed symmetrically with respect to the axis of the tubular shaft 42 and the first of which communicates with the hole 50 by means of a hole 57. Within the chambers 55 and 56 are rotatably housed two helically toothed wheels respectively indicated 58 and 59, retained within the respective chambers 55 and 56 by a cover 60 connected, by screws 61, to the axial end face of the cylindrical body 54 facing the outer periphery of the blade carrier head 10.

Through the cylindrical body 54 is formed a hole 62 perpendicular to the axis of the shaft 42 and substantially tangential to the chambers 55 and 56, with which it communicated laterally. Within the hole 62 is housed a rotatable shaft 63 including two sections constituted by worm screws 64 and 65 respectively meshing with the toothed wheels 58 and 59. Close to each of its ends shaft 63 has an annular groove 66 within which is housed an annular seal 67 serving as a friction element to prevent the accidental rotation of the shaft 63. This latter has, at its axial end, a shaped hole 68 which can be engaged by a key not illustrated.

The shaft 63 constitutes, together with its worm screws 64 and 65, an adjustment means 69 for simultaneously adjusting the angular position of the toothed wheels 58 and 59 about their axes.

The toothed wheel 58 is cup-shaped and concave towards the blade carrier head 10, and is traversed by a plurality of axial channels 70 extending between an end recess 71 communicating with the hole 57 and an eccentric cavity 72 facing the blade carrier head 10. To the toothed wheel 58 is axially connected a grinding wheel 73 of frusto-conical form, which is coaxial with the cavity 72 and is supported by a rotatable shaft 74 which is angularly connected to drive means including a rotor 75 (FIG. 3) of a pneumatic motor 76 including a stator 77 axially connected to the rotor 75 and retained in axial position and axially fixed to the interior of the cavity 72 by a cover 78 fixed to the toothed wheel 58 by screws 79.

As illustrated in FIG. 3, the stator 77 is traversed by a plurality of inclined channels 80 in the form of injectors, which communicate on one side with the end of the channels 70 and on the other with a plurality of V-shape channels 81 formed through the rotor 75.

Within the toothed wheel 59 is housed an eccentric mass 88 serving as a counter weight for balancing the grinding wheel carrier head 43 dynamically about the axis of the shaft 42. Preferably, in the example illustrated, the mass 82 and the grinding wheel 73 with the associated pneumatic motor 76 have a substantially equal weight and are consequently disposed in positions which are always symmetrical with respect to the axis of the shaft 42 whatever the angular position in which the toothed wheels 58 and 59 become located by acting on the shaft 63.

In use, the grinding wheel carrier head 43 is carried into rotation in a given phase relation with the blade carrier head 10 by the drive train 7, 12, 13, 14, 15, 22 and 24 for the purpose of permitting sharpening of the cutting edge of each blade 11 by the grinding wheel 73.

The above mentioned phase relation can be slightly modified, if necessary, by acting on the adjustment device 25. This latter is made operative by releasing the nut 29 and turning by means of a key (not illustrated), the pin 27 about its own axis. Rotation of the pin 27 corresponds to a transverse sliding of the pin 30 along the slot 31 and a rotation of the body 21 and the toothing 22 with respect to the cylindrical body 20 and the shaft 15.

By acting on the flange 34 it is possible moreover to adjust the axial distance of the grinding wheel 73 from the cutting edge of the blade 11. In fact, rotation of the flange 34 and, therefore, of the tubular body 33 corresponds to a variation of the axial position of the body 33 itself along the hole 32, which does not involve any interruption in the connection between the toothed wheel 44 and the toothing 22 because of the greater height of the teeth of this latter with respect to the teeth of the former.

The adjustment device 69 further permits the distance between the grinding wheel 73 and the axis of the shaft 42 to be adjusted for the purpose of achieving a correct sharpening connection between the grinding wheel 73 and the cutting edge of each blade 11 for each angle of inclination of this latter with respect to the blade carrier head 10. The above mentioned distance adjustment is made possible, without any replacement of pieces, by the presence of the pneumatic motor 76 which allows the transmission of the rotary motion to the grinding wheel 73 whatever position this latter occupies on the grinding wheel carrier head 43.

Finally, it is to be observed that the eccentric mass 82 can be constituted by a second grinding wheel, driven and mounted on the toothed wheel 59 in the manner just described with reference to the grinding wheel 73. By means of such a contrivance it is possible to reduce the speed of rotation of the grinding wheel carrier head 43.

We claim:

1. A cutting device for continuous rods of smoking products, in particular cigarettes, comprising a blade carrier head (10) rotatable about a first axis the inclination of which is adjustable and provided with at least one outer radial blade (11) disposed in an inclined position with respect to the said first axis, a grinding wheel carrier head (43) mounted on a support (17,33) for rotation with respect to this latter about a second axis substantially perpendicular to the said first axis and facing the outer periphery of the said blade carrier head (10), a drive train (7; 12–15; 22,44) between the said blade carrier head (10) and the said grinding wheel carrier head (43) for driving this latter to rotate about the said second axis in a determined phase relation with the angular position of the said blade carrier head (10) about the said first axis, a grinding wheel (73) mounted eccentrically on the said grinding wheel carrier head (43) and able to cooperate with a cutting edge of each said blade (11), adjustment means (69) for adjusting the eccentricity of the said grinding wheel (73), and drive means (76) for driving the said grinding wheel (73) to rotate about a third axis parallel to the said second axis, characterised by the fact that the said grinding wheel carrier head (43) includes an eccentric balancing mass (82), the said adjustment means (69) being operable to simultaneously displace, in opposite senses and a direction transverse the said second axis, both the said grinding wheel (73) and the said balancing mass (82), and the said drive means including a pneumatic motor (76).

2. A device according to claim 1, characterised by the fact that the said adjustment means (69) include first and second toothed wheels (58, 59) mounted on the said grinding wheel carrier head (43) and rotatable about respective axes parallel to the said second axis and disposed symmetrically with respect thereto, and an adjustment shaft (63) disposed perpendicularly with respect to the said second axis and including two sections constituted by worm screws (64, 65) respectively coupled to the said first and second toothed wheels (58, 59), these latter supporting the said grinding wheel (73) and the said balancing mass (82) respectively.

3. A device according to claim 1, characterised by the fact that the said drive train (7; 12–15; 22, 44) includes adjustment means (25) for adjusting the said phase relation.

4. A device according to claim 3, characterised by the fact that the said adjustment means (25) for adjusting the phase relation include a cylindrical body (20) keyed on a transmission shaft (15), a cup-shaped body (21) keyed on the said cylindrical body (20) and having an outer toothing (22) coupled to a toothed wheel (44) of the said drive chain, and a pin (27) rotatably mounted through an eccentric hole (28) of the said cup-shape body (21) and having an eccentric axial projection (30) engaged in a transversely slidable manner within a radial slot (31) formed in the said cylindrical body (20).

5. A device according to claim 1, characterised by the fact that the said support (17, 33) includes a first portion (17) fixed to a second portion (33) which is movable with respect to the first in a direction parallel to the said second axis; the said second portion (33) rotatably supporting the said grinding wheel carrier head (43); and locking means (35) interposed between the said first and second portions (17;33) to prevent accidental displacement of this latter with respect to the first.

6. A device according to claim 5, characterised by the fact that the said second portion includes a tubular body (33) coaxial with the said second axis and screwed through a threaded hole (32) of the said first portion (17); the said tubular body (33) having a radial driving flange (34) and the said locking means (35) being interposed between the said flange (34) and the said first portion (17) of the said support.

7. A device according to claim 6, characterised by the fact that the said locking means (35) include a plurality of seats (40) uniformly distributed around the said second axis on the surface of the said flange (34), and a ball (39) carried by the said first portion (17) of the said support and operable to selectively engage the said seats (40) under the thrust of resilient means (38).

8. A device according to claim 1, characterised by the fact that the said eccentric mass (82) is constituted by a second grinding wheel (73) provided with associated drive means (76).

* * * * *